United States Patent [19]

Pfeifer

[11] 4,339,914

[45] Jul. 20, 1982

[54] METHOD AND APPARATUS FOR CLEANING AN OPEN-END SPINNING ROTOR

[75] Inventor: Hermann Pfeifer, Moillesulaz, Switzerland

[73] Assignee: Officine Savio, S.p.A., Pordenone, Italy

[21] Appl. No.: 163,104

[22] Filed: Jun. 26, 1980

[30] Foreign Application Priority Data

Jun. 26, 1979 [CH] Switzerland ..... 5935/79

[51] Int. Cl.[3] ..... D01H 11/00

[52] U.S. Cl. ..... 57/302

[58] Field of Search ..... 57/302, 300, 301

[56] References Cited

U.S. PATENT DOCUMENTS

| | | | |
|---|---|---|---|
| 3,524,312 | 8/1970 | Landwehrkamp et al. | 57/302 |
| 3,597,911 | 8/1971 | Schiltknecht et al. | 57/302 |
| 3,810,352 | 5/1974 | Miyazaki et al. | 57/302 X |
| 4,057,955 | 11/1977 | Roehrich | 57/302 |
| 4,058,963 | 11/1977 | Stahlecker | 57/302 |
| 4,125,991 | 11/1978 | Stahlecker | 57/302 |

FOREIGN PATENT DOCUMENTS

| | | |
|---|---|---|
| 2410269 | 9/1975 | Fed. Rep. of Germany . |
| 2618094 | 11/1977 | Fed. Rep. of Germany . |

*Primary Examiner*—Donald Watkins

*Attorney, Agent, or Firm*—Stevens, Davis, Miller & Mosher

[57] ABSTRACT

Device for cleaning an open-ended spinning turbine comprises a bell which can be fitted to a container holding the spinning rotor and which is mounted on an arm operated by a jack.

The bell bears a piston of which the front tapered end probes the bottom of the throat for uniting the fibers in the rotor when the bell is joined to the container.

The procedure consists in letting a certain quantity of fibers enter after breakage of the yarn so as to form a ring of fibers in the rotor and then to press this ring by means of the piston until the rotor stops, while the scraping or rubbing of the ring of fibers enables the impurities stuck in the area of the throat for uniting the fibers to be detached.

2 Claims, 3 Drawing Figures

METHOD AND APPARATUS FOR CLEANING AN OPEN-END SPINNING ROTOR

This invention rotates to a procedure for cleaning a rotor of a unit in an open-ended spinning frame, and a device for carrying out the procedure. The invention also rotates to a spinning frame of the open-ended type that utilizes the procedure and the relative device.

It is known that, when yarn produced with an open-ended type spinning frame breaks, this is due to the impurities which have built up in the rotor and, to be more exact, in the throats for uniting the fibres where the latter are twisted to form the yarn.

Before starting to re-attach the yarn it is clearly necessary to clean the rotor so as to free it of all the impurities which are inside it.

Several solutions to this have been put forward. Some of them are of a purely pneumatic type and consist in introducing compressed air so as to detach and remove the impurities sticking to the rotor and then remove the detached impurities by suction.

There are other solutions which are partly or wholly mechanical and consist in scraping with a probe device the bottom of the throat where the fibers are united in the rotor in order to detach the impurities. Amongst the partly mechanical solutions there are two which have been described in DE OS 2410269 and 2618094. In some cases the discharge of impurities is carried out pneumatically, whereas in other cases a temporary holding means, a brush for instance, is used and holds in itself the impurities and fibers which have remained.

The purely pneumatic solutions are not always effective and can often not remove the dirt. In the case of mechanical solutions care has to be taken that they do not damage the rotor and, in particular, the throat where the fibers are united. Lastly, the systems for cleaning with brushes or other temporary holding means need continuous maintenance, for the impurities of the fibers build up on the hairs of the brushes. However, mechanical cleaning is undoubtedly the simplest and most effective way to remove impurities from a surface.

The purpose of this invention is to put forward a mechanical procedure for cleaning the rotor that provides full certainty of effectiveness without involving any danger to the surface of the throat where the fibers are united.

Furthermore, the invention takes into account a cleaning procedure that uses a device having a simple concept and method of working whereby no special maintenance is needed such as that required for cleaning a brush. For this reason the invention has as its object a procedure for cleaning the rotor of a spinning unit in an open-ended type spinning frame whereby the procedure is characterized by the fact that, after the spinning process has been halted, a certain quantity of fibers is introduced into the rotating rotor so as to form a ring of fibers on the periphery of said rotating rotor, the connection providing drive between the turbine and the device driving the spinning frame is removed, the ring of fibers is held at an angle until the scraping or rubbing of said ring against the rotor stops the movement of the latter, the ring is freed and the whole of the impurities detached from inside the rotor is discharged.

The invention also has as its object a device for carrying out procedure, wherein each spinning unit comprises a spinning device consisting of two parts hinged and linked together. Of these parts one forms a supporting container in which the spinning rotor is lodged, while the other contains the control means feeding the fibers and is itself hinged to the casing of the spinning frame, to which it also is anchored by means of a hook means which can be moved so as to be able to be placed in two different positions; one of these positions is the closed spinning position where the two said parts are assembled together, whereas the other position is the open cleaning position wherein the two parts are separated. Each spinning unit also comprises a yarn feeler means to detect any breakage of the yarn, the means being connected to a mechanism to engage the control means feeding the fibers. The device is characterized by the fact that the detector means is connected to the mechanism with a delay organ, and also by the fact that it comprises a movable cleaning head with a bell of which the edges can be adapted to the supporting container. The wall of the bell includes at least a first passage for connection to a source of suction and a second passage of which the lengthwise axis passes through the end of the throat for uniting fibers in the rotor when the bell has been adapted to the container, a cylinder equipped with a piston being installed coaxially with the second passage and connected to motor means able to move the front end of the piston towards the throat. The attached table shows diagrammatically, as an example, one type of lay-out of the device to carry out the procedure which is the object of the invention.

Figure 1:
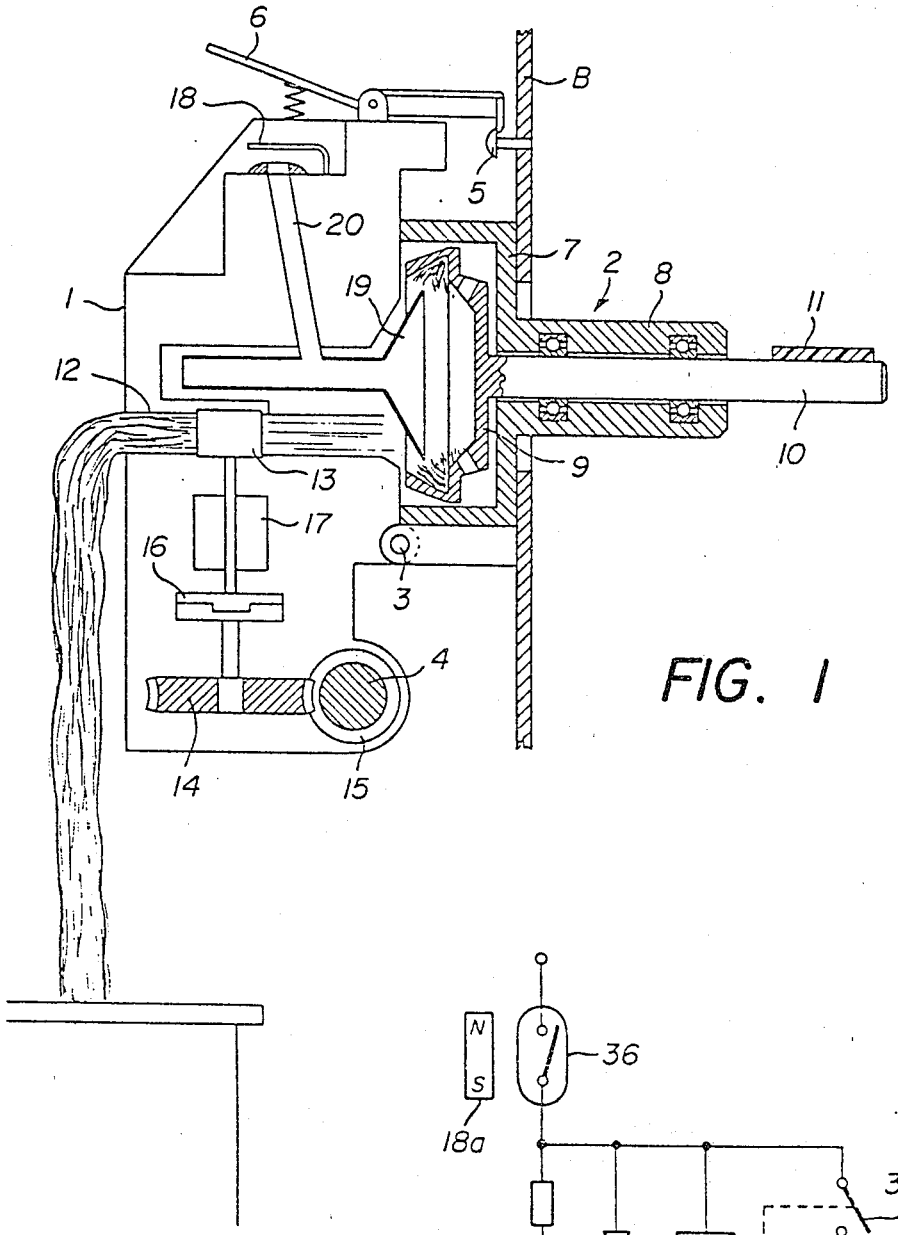
FIG. 1 is a side view of the section of a closed spinning unit.

The spinning unit shown in FIG. 1 is represented during the phase of preparation for the actual cleaning operation. The spinning unit comprises a device consisting of two parts, 1 and 2, connected to each other with a hinge 3. Part 1 is hinged, on the one hand, to the casing of the spinning frame with a shaft 4, which is at the same time the motive and drive shaft for the mechanism feeding the fibres, which will be described hereinafter.

Part 1 is fixed, on the other hand, to the casing B of the spinning frame with a hook means, for instance, which is diagramatically shown with a retaining tooth 5 and a spring catch 6 intended to engage the retaining tooth 5 in an elastic manner. Part 2 of the spinning device consists of a container having the shape of an axially-open rotation body 7 and of a support, which has a tubular form 8 in the example and communicates coaxially with the end of the container 7.

The container 7 accommodates within itself the spinning rotor 9, which has the shape of a bowl solidly fixed to the shaft 10, which passes through the support 8 and of which the end is engaged by the drive belt 11 of the spinning frame. Part 1 of the spinning device consists essentially of a mechanism to feed fibers which comprises an inlet channel for the slivers of fibers 12, wherein the slivers themselves are conveyed by a grooved pulley 13 connected to the motive or drive shaft 4 by a gear wheel 14 engaged in a worm screw 15 solidly fixed to the shaft 4.

A clutch mechanism 16 is positioned between the wheel 14 and pulley 13 and is operated by an electromagnet 17 connected to the communication mechanism of a yarn breakage detector 18, which will be described hereinafter.

The channel for the slivers of fibres 12 opens out onto the rear of a stationary fibers separation disk 19, which is solidly fixed to part 1 of the spinning device and is enclosed by the bowl of the spinning rotor 9.

Figure 2:
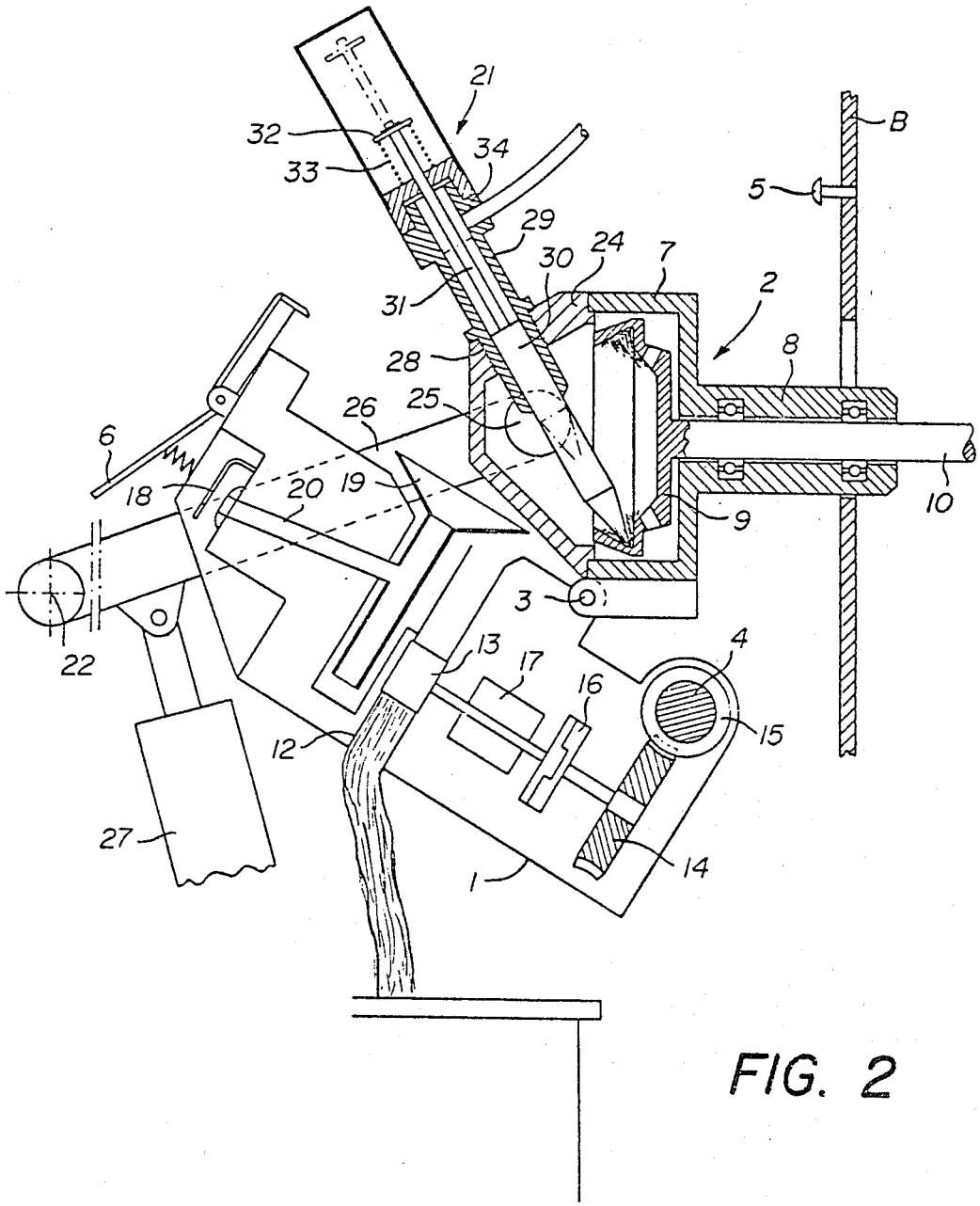
FIG. 2 is a side view of the section of an open spinning unit together with the cleaning device.

Disk 19 serves to apportion the fibres over the periphery of the rotor 9. The middle of the disk 19 is hollow and communicates with a lateral conduit 20 that serves to discharge the yarn produced in the rotor 9 and that opens out close to the yarn breakage detector 18. FIG. 2 shows the spinning device in its open position to allow the application of a cleaning head 21 to the axial opening of the container 7.

Head 21 is articulated around an axle 22 positioned on a carriage (not shown here) installed on a guide rail solidly fixed to the casing of the spinning frame so as to be moved along the spinning frame in front of the spinning units mounted alongside one other.

The carriage is the one used for re-attachment of the yarn and has been described and shown in a patent belonging to the author of this invention.

Cleaning head 21 includes a bell 24 of which the edge adapts itself to the edge of the axial opening of the container 7 in such a way as to form, together with the container, an enclosed housing around the spinning rotor 9.

Two opposed openings 25, of which only one can be seen in FIG. 2, pass through the wall of the bell. The openings are connected to a source of suction by means of two arms 26 which are hinged to the carriage 22 and which enable the cleaning head 21 to be turned over between two limit or end positions, the overturning being brought about by a jack 27.

The bell 24 has another opening 28 of which the length wise axis passes clearly through the throat where the fibers are united in the rotor 9 wherever the bell 24 is applied to the container 7 owing to the action of the jack 27.

A cylinder 29 is fixed coaxially in the opening 28 and contains a piston 30 solidly fixed to a shaft 31 onto the rear end of which a disk 32 is applied.

A return spring 33 is fitted so as to press on one side against the disk 32 and on the other side against the rear face of the cylinder 29. Cylinder 29 is connected with a side opening 34 to a source of fluid under pressure (not shown here). The front part of the piston 30 ends in a cone having a slightly rounded point.

Figure 3:
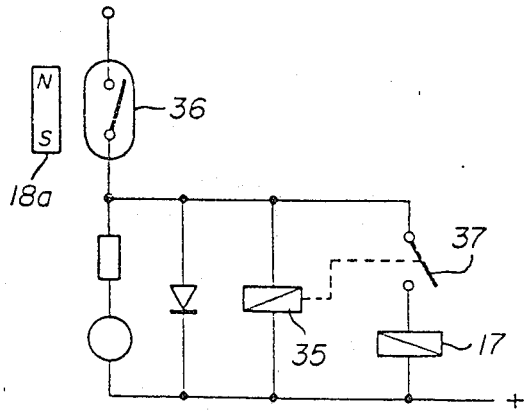
FIG. 3 is an electrical lay-out of the control mechanism for engaging the control means feeding the fibres.

The electrical circuit of FIG. 3 shows the connection between a time-delay relay 35 and the relay with protected magnetic contacts (reed-relay) 36 controlled by a permanent magnet 18*a* solidly fixed to the yarn breakage detector 18.

The time-delay relay 35 controls a switch 37 positioned in series with the electromagnet 17 controlling the clutch 16.

FIG. 1 shows the spinning unit at the moment when the yarn produced by the rotor 9 is broken. The yarn breakage detector 18 oscillates and cuts off the supply to the rotor of the fibers 9. However, owing to the presence of the time-delay relay 35 in the circuit controlling the electromagnet 17, the application of current to the latter is delayed.

The value of this delay is chosen to enable a certain quantity of fibers to be introduced into the rotor 9 and is determined by the said time-delay relay 35.

Since the rotor 9 is driven by the belt 11 during this introduction of fibers, the fibers build up and form a ring in the rotor itself. This is the phase of preparation for the actual cleaning operation itself.

Next, the spinning chamber is opened by means of the catch 6 and the cleaning head is brought into the cleaning position by the jack 27.

The spinning device is turned over forwards and, when it has opened, part 2 of the device also is thrust forwards and slides on a supporting surface of the casing B, on which it is held tight by the drive belt 11 so that the shaft 10 of the rotor is disengaged from the belt and lets the rotor 9 rotate freely.

At this moment the piston 30 is moved towards the throat where the fibers are united in the rotor 9. Its tapered end penetrates onto the ring of accumulated fibers and halts them without touching or coming into contact with the throat, while the rotor 9 continues rotating through inertia. The rotor 9 is then braked heavily by the rubbing of the clamped ring of fibers.

The gap between the point of the piston 30 and the throat when the ring of fibers is halted is of the order of one millimeter. The scraping or rubbing serves to detach the impurities which have built up in the throat where the fibers are united during spinning.

When the rotor 9 too is halted, the piston 30 is withdrawn by the return spring 33. The fibres and impurities detached from the rotor 9 are sucked away through the openings 25 in the bell 24.

The advantages of this process lies, on the one hand, in its efficient cleaning and, on the other hand, in the fact that the cleaning agent consists of fibres introduced after the end of the spinning process, and the fibers are discharged together with the impurities by suction.

As a result the cleaning tool, which consists of the piston 30, accumulates no impurities and does not require the regular maintenance needed especially in the case of brushes.

Lastly, it should be noted once again that, contrary to other mechanical cleaning systems, it is not necessary to apply special means to turn the rotor 9 since the latter uses the kinetic energy imparted to it by the drive mechanism 11 of the spinning frame.

I claim:

1. A process for cleaning a driven rotor of a spinning unit in an open-ended type spinning frame, comprising after stopping the spinning procedure introducing a certain quantity of fibers into the rotating rotor so as to form a ring of fibers at the periphery of said rotating rotor, disconnecting the rotor from a positive drive device driving the spinning frame, holding the ring of fibers at an angle against the rotor until the friction between said ring of fibers and the rotor halts the rotor, freeing said ring of fibers from contact with said rotor and discharging said ring of fibers together with the detached impurities lying in said rotor.

2. A spinning unit of an open-ended type spinning frame comprising a casing, a supporting container on said casing, a spinning rotor mounted in said supporting container, means for feeding fibers to said rotor hinged to said casing to permit movement of said feeding means toward and away from said rotor, a yarn feeler means to detect breakage of yarn, a clutch mechanism engaging said feeding means and a delay organ, said clutch mechanism being connected to said feeder means through said delay organ, a device for cleaning said rotor when said feeding means is moved away from said rotor comprising a bell having edges adapted to coincide with edges of said supporting container, said bell defining a first passage connectable to a source of suction and a second passage having an axis passing through the end of a throat of the rotor which unite the fibers, a cylinder coaxially positioned within said second passage and a piston positioned within said cylinder connected to means to move the piston towards said throat to enable the piston to hold fibers against said throat.

* * * * *